US012344940B2

(12) United States Patent
Noguchi et al.

(10) Patent No.: US 12,344,940 B2
(45) Date of Patent: Jul. 1, 2025

(54) MARTENSITIC STAINLESS STEEL PIPE AND METHOD OF MANUFACTURING THE SAME

(71) Applicant: NIPPON STEEL CORPORATION, Tokyo (JP)

(72) Inventors: Mikiko Noguchi, Tokyo (JP); Takashi Yamaguchi, Tokyo (JP)

(73) Assignee: NIPPON STEEL CORPORATION, Tokyo (JP)

( * ) Notice: Subject to any disclaimer, the term of this patent is extended or adjusted under 35 U.S.C. 154(b) by 693 days.

(21) Appl. No.: 17/594,934

(22) PCT Filed: Jul. 17, 2020

(86) PCT No.: PCT/JP2020/027940

§ 371 (c)(1),
(2) Date: Nov. 3, 2021

(87) PCT Pub. No.: WO2021/015140

PCT Pub. Date: Jan. 28, 2021

(65) Prior Publication Data

US 2022/0195610 A1 Jun. 23, 2022

(30) Foreign Application Priority Data

Jul. 24, 2019 (JP) ..... 2019-136198

(51) Int. Cl.
*C23G 1/08* (2006.01)
*C22C 38/00* (2006.01)
(Continued)

(52) U.S. Cl.
CPC ..... *C23G 1/086* (2013.01); *C22C 38/001* (2013.01); *C22C 38/002* (2013.01); *C22C 38/02* (2013.01);
(Continued)

(58) Field of Classification Search
CPC ..... C23G 1/086; C23G 3/04; C22C 38/002; C22C 38/02; C22C 38/04; C22C 38/06; C22C 38/44
See application file for complete search history.

(56) References Cited

U.S. PATENT DOCUMENTS 6,440,234 B1 8/2002 Amaya et al.
2015/0013716 A1* 1/2015 Masuoka ..... C22C 38/04 134/3
2020/0270715 A1 8/2020 Endo et al.

FOREIGN PATENT DOCUMENTS

EP 1022357 A1 * 7/2000 ..... C23F 15/00
JP 63176445 A 7/1988
(Continued)

OTHER PUBLICATIONS

Higginson R. L. et al.; "Effect of thermally grown oxides on colour development of stainless steel", Materials at High Temperatures, vol. 32, No. 1-2, pp. 113-117; Jan. 1, 2015.

*Primary Examiner* — Anthony M Liang
(74) *Attorney, Agent, or Firm* — Greer, Burns & Crain, Ltd.

(57) ABSTRACT

A method of manufacturing a martensitic stainless steel pipe includes: preparing a hollow shell, S1; a pickling step, S3-2, in which the hollow shell is immersed in nitrohydrofluoric acid solution at a temperature below 50° C.; after pickling step S3-2, a high-pressure water washing step, S4, in which high-pressure water is injected onto the outer surface of the hollow shell to clean the outer surface of the hollow shell; after high-pressure water washing step S4, a hot-water immersion step, S5, in which the hollow shell is immersed in hot water if necessary; and spraying gas onto the surface of the hollow shell, S6, before a lapse of 15 minutes from completion of high-pressure water washing step S4 or hot-water immersion step S5.

4 Claims, 2 Drawing Sheets

(51) Int. Cl.

| | |
|---|---|
| ***C22C 38/02*** | (2006.01) |
| ***C22C 38/04*** | (2006.01) |
| ***C22C 38/06*** | (2006.01) |
| ***C22C 38/42*** | (2006.01) |
| ***C22C 38/44*** | (2006.01) |
| ***C22C 38/46*** | (2006.01) |
| ***C22C 38/48*** | (2006.01) |
| ***C22C 38/50*** | (2006.01) |
| ***C22C 38/52*** | (2006.01) |
| ***C23G 3/04*** | (2006.01) |
| ***C23G 5/00*** | (2006.01) |

(52) U.S. Cl.

CPC ..... *C22C 38/04* (2013.01); *C22C 38/06* (2013.01); *C22C 38/42* (2013.01); *C22C 38/44* (2013.01); *C22C 38/46* (2013.01); *C22C 38/48* (2013.01); *C22C 38/50* (2013.01); *C22C 38/52* (2013.01); *C23G 3/04* (2013.01); *C23G 5/00* (2013.01)

(56) References Cited

FOREIGN PATENT DOCUMENTS

| | | | | |
|---|---|---|---|---|
| JP | 2001123249 | A | | 5/2001 |
| JP | 2002371394 | A | * | 12/2002 |
| JP | 3489535 | B2 | | 1/2004 |
| JP | 2005097682 | A | * | 4/2005 |
| JP | 5482968 | B2 | | 5/2014 |
| JP | 5644148 | B | | 12/2014 |
| JP | 5896165 | B2 | | 3/2016 |
| WO | 2019065116 | A1 | | 4/2019 |

* cited by examiner

MARTENSITIC STAINLESS STEEL PIPE AND METHOD OF MANUFACTURING THE SAME

TECHNICAL FIELD

The present invention relates to a martensitic stainless steel pipe and a method of manufacturing such a steel pipe.

BACKGROUND ART

Petroleum and natural gas produced in oil and gas wells contain associated gases, i.e., corrosive gases such as carbon dioxide and hydrogen sulfide. A martensitic stainless steel pipe containing Cr in about 13 mass % has an excellent balance between corrosion resistance and economy, and is widely used as a steel pipe for oil wells or a steel pipe for pipelines.

Generally, a process for manufacturing a steel pipe may include the step of pickling the surface of the steel pipe. During the pickling step, the steel pipe is immersed in a pickling tank. After the pickling step, the steel pipe is water washed and dried.

For example, Japanese Patent Nos. 5896165 and 5482968 each discloses a method for preventing yellowing of the surface of steel sheet by means of pickling. Japanese Patent 3489535 discloses a method of manufacturing a martensitic stainless steel pipe including shot blasting and pickling after heat treatment. Japanese Patent No. 5644148 discloses a stainless cold-rolled steel pipe that prevents a type of surface roughness called orange peel, and a method of manufacturing such a steel pipe. JP 2002-371394 A discloses a pickling method for removing oxide scales produced on the surface of stainless steel.

DISCLOSURE OF INVENTION

The outer surface of a martensitic stainless steel pipe is sometimes covered with resin through application of a coating. A coating resin may prevent corrosion of steel pipe caused by seawater, for example. A high adhesion between the coating resin and steel pipe is preferred.

An object of the present invention is to provide a martensitic stainless steel pipe that achieves sufficient adhesion to its coating resin, and a method of manufacturing such a steel pipe.

A method of manufacturing a martensitic stainless steel pipe according to an embodiment of the present invention includes: preparing a hollow shell; a pickling step in which the hollow shell is immersed in nitrohydrofluoric acid solution (nitric hydrofluoric acid solution) at a temperature below 50° C.; after the pickling step, a high-pressure water washing step in which high-pressure water is injected onto an outer surface of the hollow shell to clean the outer surface of the hollow shell; after the high-pressure water washing step, a hot-water immersion step in which the hollow shell is immersed in hot water if necessary; and a gas spraying step in which the surface of the hollow shell is sprayed with gas before a lapse of 15 minutes from completion of the high-pressure water washing step or hot-water immersion step. The hollow shell has a chemical composition of, in mass %: 0.001 to 0.050% C; 0.05 to 1.00% Si; 0.05 to 1.00% Mn; up to 0.030% P; up to 0.0020% S; below 0.50% Cu; 11.50 to below 14.00% Cr; above 5.00 to 7.00% Ni; above 1.00 to 3.00% Mo; 0.02 to 0.50% Ti; 0.001 to 0.100% Al; 0.0001 to 0.0040% Ca; 0.0001 to below 0.0200% N; 0 to 0.500% V; 0 to 0.500% Nb; 0 to 0.500% Co; and balance Fe and impurities.

The present invention provides a martensitic stainless steel pipe that achieves sufficient adhesion to its coating resin.

EMBODIMENTS FOR CARRYING OUT THE INVENTION

Figure 1:
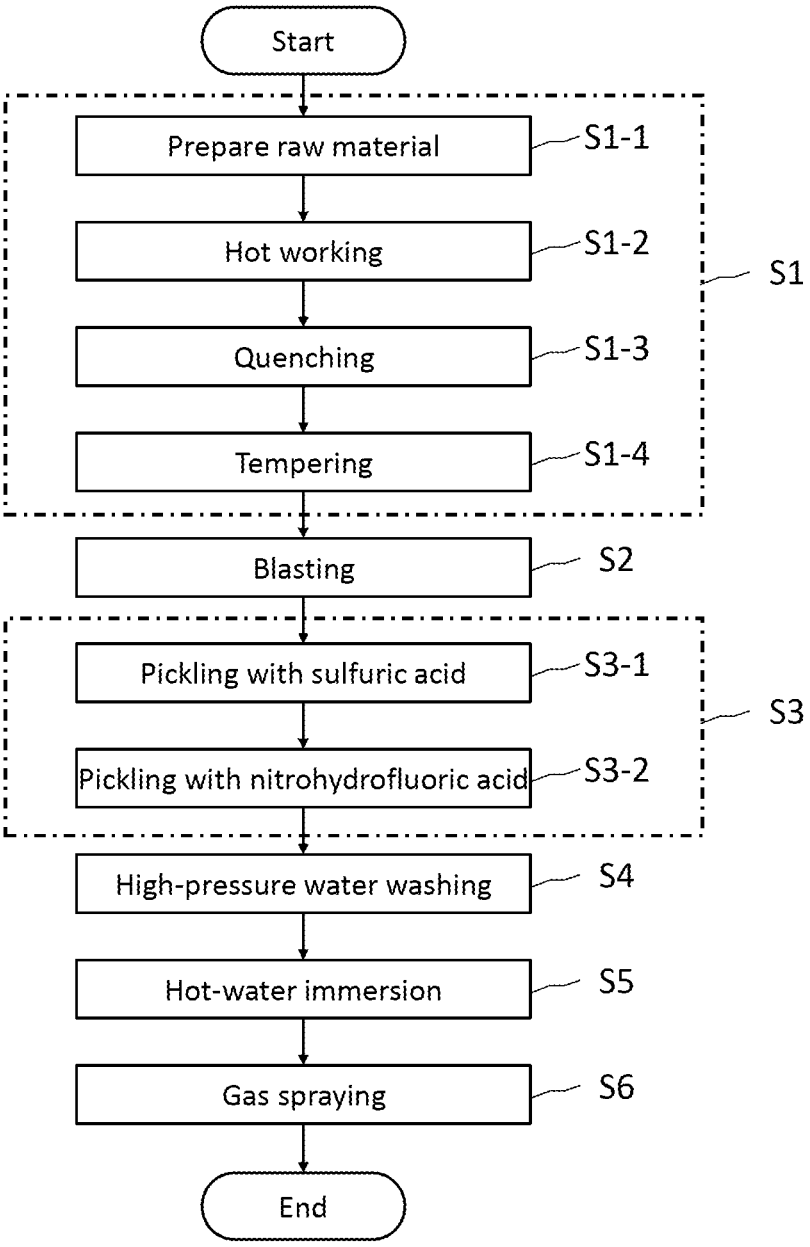
FIG. 1 is a flowchart of a method of manufacturing a steel pipe according to an embodiment of the present invention.

Traditionally, for martensitic stainless steel, particularly martensitic stainless steel pipe used as steel pipe for pipelines or in oil wells, finished skin does not represent an essential requirement, and thus pickling after heat treatment is not indispensable. Other applications of martensitic stainless steel involve blades; however, since blades are ultimately polished prior to use, pickling is not essential.

The inventors performed pickling as a step during manufacture of various martensitic stainless steel pipes. Martensitic stainless steel pipe containing Cr in about 13 mass %, if subjected to nitrohydrofluoric acid pickling, exhibits a beautiful silver surface appearance; however, a visual inspection revealed that yellowing sometimes occurred. The inventors found that, when a coating is applied to such a steel pipe, a yellowed portion has a reduced adhesion with respect to its coating resin. The inventors conducted further investigations to find out conditions for pickling and other manufacturing steps to prevent a decrease in the adhesion of pipe with respect to the coating resin.

For example, JP 2002-371394 A describes conditions for descaling austenitic stainless steel (SUS304) through pickling. However, although both martensitic stainless steel and austenitic stainless steel are categorized as stainless steel, they have significant differences and are recognized by a person skilled in the art as different materials. It cannot be said that a technique for one steel can always be used for another. The same applies to the pair of martensitic stainless steel and ferritic stainless steel.

Martensitic stainless steel is different from austenitic stainless steel and ferritic stainless steel not only in microstructure, but also in chemical composition. Different microstructures and different chemical compositions mean different reactivities to pickling solution. Further, different heat-treatment conditions are applied, leading to formation of scales in different states and dechromation in different manners. For example, a ferritic stainless steel that has been subjected to solution heat treatment and a martensitic stainless steel that has been tempered are significantly different in the form of alloying elements (i.e., dissolved or precipitated). Further, while austenitic stainless steel is subjected to solution treatment such that the added elements are dissolved within the grains, martensitic stainless steel is tempered such that the added elements precipitate within the grains and along the grain boundaries. Therefore, the conditions for pickling and the subsequent treatment for austenitic stainless steel or ferritic stainless steel cannot be applied to martensitic stainless steel without any modifications.

The inventors closely examined how pickling affects martensitic stainless steel pipe, and arrived at the conclusion that the color of the surface of martensitic stainless steel pipe that has been pickled can be controlled by conditions for manufacturing steps. They found that, if the color of the surface of martensitic stainless steel pipe that has undergone pickling and the subsequent treatment falls within a predetermined range, the pipe's adhesion to its coating resin can be ensured. The following embodiment is based on this finding.

A first method of manufacturing a martensitic stainless steel pipe according to an embodiment of the present invention includes: preparing a hollow shell; a pickling step in which the hollow shell is immersed in nitrohydrofluoric acid solution at a temperature below 50° C.; after the pickling step, a high-pressure water washing step in which high-pressure water is injected onto an outer surface of the hollow shell to clean the outer surface of the hollow shell; and a gas spraying step in which the outer surface of the hollow shell is sprayed with gas before a lapse of 15 minutes from completion of the high-pressure water washing step. The hollow shell has a chemical composition of, in mass %: 0.001 to 0.050% C; 0.05 to 1.00% Si; 0.05 to 1.00% Mn; up to 0.030% P; up to 0.0020% S; below 0.50% Cu; 11.50 to below 14.00% Cr; above 5.00 to 7.00% Ni; above 1.00 to 3.00% Mo; 0.02 to 0.50% Ti; 0.001 to 0.100% Al; 0.0001 to 0.0040% Ca; 0.0001 to below 0.0200% N; 0 to 0.500% V; 0 to 0.500% Nb; 0 to 0.500% Co; and balance Fe and impurities.

The first manufacturing method above will ensure the adhesion of martensitic stainless steel pipe to its coating resin. While the mechanism with which a pipe's adhesion to its coating resin decreases is unknown, the inventors attribute it to substances adhering to the surface of the steel pipe. Such adhering substances are thought to cause coloring of martensitic stainless steel pipe in yellow. The inventors found that, if martensitic stainless steel pipe having the above chemical composition is immersed in nitrohydrofluoric acid solution at a temperature below 50° C., production of adhering substances on the surface of the steel pipe can be reduced to reduce coloring in yellow. They also found that production of adhering substances can be reduced by performing high-pressure water washing after pickling and then, before a lapse of 15 minutes, performing gas spraying. That is, production of adhering substances on the surface of a hollow shell can be reduced to prevent a decrease in adhesion if, during the manufacturing process, the hollow shell is immersed in nitrohydrofluoric acid solution at a temperature below 50° C., followed by high-pressure water washing and gas spraying, and the hollow shell is not left wet for 15 minutes or longer.

In martensitic stainless steel, grain boundaries can be dissolved by nitrohydrofluoric acid more easily than in ferritic stainless steel or austenitic stainless steel. When martensitic stainless steel is immersed in nitrohydrofluoric acid, the surface of the steel pipe, particularly the grain boundaries, are dissolved. That is, in martensitic stainless steel after pickling with nitrohydrofluoric acid, nitrohydrofluoric acid has seeped into the grain boundaries and is present therein. If high-pressure water washing is then performed but gas spraying is not performed and the hollow shell remains wet for 15 minutes or longer, nitrohydrofluoric acid remaining in the grain boundaries comes out on the surface of the steel pipe. This is thought to lead to the production of adhering substances. Thus, the inventors assume that it is important to perform gas spraying before a lapse of 15 minutes from high-pressure water washing. The first manufacturing method above solves a problem specific to martensitic stainless steel.

In connection with the gas spraying step, spraying gas onto the outer surface of the hollow shell before a lapse of 15 minutes from completion of the high-pressure water washing step means that the time interval between the completion of injection of high-pressure water onto the outer surface of the hollow shell in the high-pressure water washing step and the initiation of spraying of gas on the outer surface of the hollow shell is shorter than 15 minutes.

The method of manufacturing martensitic stainless steel pipe above may include the step of performing heat treatment on the hollow shell. The heat treatment step may include, for example, quenching of the hollow shell. Quenching is a heat treatment in which steel is re-heated to a temperature not lower than the $A_{c3}$ point and then rapidly cooled. In addition to the quenching of the hollow shell, the heat treatment step may include tempering of the hollow shell.

A second method of manufacturing a martensitic stainless steel pipe according to the embodiment of the present invention includes: preparing a hollow shell; a pickling step in which the hollow shell is immersed in nitrohydrofluoric acid solution at a temperature below 50° C.; after the pickling step, a high-pressure water washing step in which high-pressure water is injected onto an outer surface of the hollow shell to clean the outer surface of the hollow shell; after the high-pressure water washing step, a hot-water immersion step in which the hollow shell is immersed in hot water; and a gas spraying step in which the outer surface of the hollow shell is sprayed with gas before a lapse of 15 minutes from completion of the high-pressure water washing step. The hollow shell has a chemical composition of, in mass %: 0.001 to 0.050% C; 0.05 to 1.00% Si; 0.05 to 1.00% Mn; up to 0.030% P; up to 0.0020% S; below 0.50% Cu; 11.50 to below 14.00% Cr; above 5.00 to 7.00% Ni; above 1.00 to 3.00% Mo; 0.02 to 0.50% Ti; 0.001 to 0.100% Al; 0.0001 to 0.0040% Ca; 0.0001 to below 0.0200% N; 0 to 0.500% V; 0 to 0.500% Nb; 0 to 0.500% Co; and balance Fe and impurities.

The second manufacturing method above includes a hot-water immersion step after the high-pressure water washing step and initiates gas spraying before a lapse of 15 minutes from completion of the hot-water immersion step to further reduce production of adhering substances on the surface of the steel pipe, thereby increasing the pipe's adhesion to its coating resin. The temperature of water in which the hollow shell is immersed at the hot-water immersion step is to be, for example, not lower than 60° C., and more preferably not lower than 80° C.

Spraying gas onto the outer surface of the hollow shell before a lapse of 15 minutes from completion of the hot-water immersion step means that the time interval between the completion of immersion of the hollow shell in hot water in the hot-water immersion step and the initiation of spraying of gas on the outer surface of the hollow shell is shorter than 15 minutes.

The time interval between the completion of injection of water onto the outer surface of the hollow shell during high-pressure water washing and the initiation of immersion of the hollow shell in hot water is to be shorter than 15 minutes, preferably shorter than 13 minutes, yet more preferably shorter than 10 minutes, and still more preferably shorter than 6 minutes.

The second manufacturing method above solves the same problem specific to martensitic stainless steel pipe as the first manufacturing method above.

In the first and second manufacturing methods above, the pickling step may be a step in which the hollow shell is immersed in sulfuric acid solution or hydrochloric acid solution and then immersed in said nitrohydrofluoric acid at a temperature below 50° C. This will facilitate removal of oxide scales on the surface of the hollow shell. In such implementations, the hollow shell that has been immersed in sulfuric acid solution or hydrochloric acid solution may be immersed in water before being immersed in said nitrohydrofluoric acid solution.

In the first and second manufacturing methods above, at the pickling step, the hollow shell may be immersed in nitrohydrofluoric acid solution at a temperature below 30° C. This will further reduce production of adhering substances on the surface of the steel pipe, further increasing the pipe's adhesion to its coating resin.

The first and second manufacturing methods above may further include immersing, in water, the hollow shell after immersion in said nitrohydrofluoric acid solution between the pickling step and the high-pressure water washing step. This will further reduce production of adhering substances on the surface of the steel pipe, further increasing the pipe's adhesion to its coating resin.

The martensitic stainless steel pipe described below can be manufactured by the above-described first or second manufacturing method. The manufacture of the martensitic stainless steel pipe described below is not limited to the above manufacturing methods.

A martensitic stainless steel pipe according to an embodiment of the present invention has a chemical composition of, in mass %: 0.001 to 0.050% C; 0.05 to 1.00% Si; 0.05 to 1.00% Mn; up to 0.030% P; up to 0.0020% S; below 0.50% Cu; 11.50 to below 14.00% Cr; above 5.00 to 7.00% Ni; above 1.00 to 3.00% Mo; 0.02 to 0.50% Ti; 0.001 to 0.100% Al; 0.0001 to 0.0040% Ca; 0.0001 to below 0.0200% N; 0 to 0.500% V; 0 to 0.500% Nb; 0 to 0.500% Co; and balance Fe and impurities.

The martensitic stainless steel pipe satisfies the following expression, (1):

$$154 \leq B \leq 255 \quad (1).$$

In this expression, B indicates a value of a blue component on a 256-level gray scale from 0 to 255, the blue component being one of three components, red, green and blue, obtained by colorimetry on an outer surface of the martensitic stainless steel pipe.

The inventors found that, if a martensitic stainless steel pipe having the above chemical composition is composed in such a way that the RGB value of the outer surface satisfies 154≤B, the pipe's adhesion to its coating resin can be ensured. In a martensitic stainless steel pipe having the above chemical composition, it is thought that only small amounts of adhering substances that affect adhesion are present on the outer surface of the steel pipe if the value for B, i.e., the blue component, in the RGB value on the outer surface observed by colorimetry is larger than a predetermined amount.

The martensitic stainless steel pipe preferably satisfies the following expressions, (2) and (3):

$$146 \leq 5R \leq 255 \quad (2), \text{ and}$$

$$142 \leq G \leq 255 \quad (3).$$

However, a case satisfying R=G=B=255 is excluded.

In these expressions, R indicates a value of a red component on a 256-level gray scale from 0 to 255, obtained by measurement of the outer surface of the martensitic stainless steel pipe. G indicates a value of a green component on a 256-level gray scale from 0 to 255, obtained by measurement of the outer surface of the martensitic stainless steel pipe.

Composing a martensitic stainless steel pipe with this RGB value range achieves reduced amounts of adhering substances on martensitic stainless steel pipe, further facilitating ensuring the pipe's adhesion to its coating resin. If the color range of a martensitic stainless steel pipe is such that all of R, G and B are in high ranges (i.e., close to white and gray) and B is in a higher range than R and G (i.e., somewhat closer to blue than to pink or yellow), it is thought that reduced amounts of adhering substances that affect adhesion are present on the outer surface of the steel pipe.

The martensitic stainless steel pipe preferably excludes a case satisfying the following expression, (4):

$$504 \leq (R-G) \times (R-B) \leq 1960 \quad (4).$$

This will ensure martensitic stainless steel pipe's adhesion to its coating resin and also improve its surface appearance.

The stainless steel pipe preferably satisfies the following expression, (5):

$$-48 \leq (R-G) \times (R-B) \leq 396 \quad (5).$$

This will ensure martensitic stainless steel pipe's adhesion to its coating resin and further improve its surface appearance.

However, the martensitic stainless steel pipe excludes a case satisfying one of the following expressions, (6) and (7):

$$(R-G) \times (R-B) = 220 \quad (6), \text{ or}$$

$$(R-G) \times (R-B) = 272 \quad (7).$$

Now, the embodiments of the present invention will be described in detail with reference to the drawings. The same or corresponding elements throughout the drawings are labeled with the same characters, and their description will not be repeated.

EMBODIMENTS

[Method of Manufacturing Martensitic Stainless Steel Pipe]

FIG. 1 is a flow chart of a method of manufacturing a martensitic stainless steel pipe according to an embodiment of the present invention. The method of manufacturing a martensitic stainless steel pipe according to the present embodiment includes: preparing a hollow shell (step S1); blasting the hollow shell (step S2); pickling the hollow shell that has been blasted (step S3); high-pressure water washing the hollow shell that has been pickled (step S4); hot-water immersing the hollow shell that has been high-pressure water washed (step S5); and a gas spraying step in which the surface of the hollow shell is sprayed with gas (step S6). These steps will be described in detail below.

[Preparing Step]

A hollow shell that has been tempered is prepared (step S1). The hollow shell is preferably a seamless steel pipe; alternatively, it may be a welded steel pipe.

The hollow shell is not limited to any particular one as long as it is a steel pipe of martensitic stainless steel; if, for example, a steel pipe for pipelines is to be made, one having the following chemical composition is suitable. In the following description, "%" for the content of an element means mass %.

C: 0.001 to 0.050%

Carbon (C) precipitates in the form of Cr carbides at weld heat-affected zones (HAZs) during welding, thus reducing SCC resistance at HAZs. On the other hand, excessively limiting C content leads to increased manufacturing costs. In view of this, C content is preferably 0.001 to 0.050%. A lower limit for C content is more preferably 0.005%, and yet more preferably 0.008%. An upper limit for C content is more preferably 0.030%, and yet more preferably 0.020%.

Si: 0.05 to 1.00%

Silicon (Si) deoxidizes steel. On the other hand, an excessively high Si content decreases the toughness of steel. In view of this, Si content is preferably 0.05 to 1.00%. A lower limit for Si content is more preferably 0.10%, and yet more preferably 0.15%. An upper limit for Si content is more preferably 0.80%, and yet more preferably 0.50%.

Mn: 0.05 to 1.00%

Manganese (Mn) improves the strength of steel. On the other hand, an excessively high Mn content decreases the toughness of steel. In view of this, Mn content is preferably 0.05 to 1.00%. A lower limit for Mn content is more preferably 0.10%, and yet more preferably 0.20%. An upper limit for Mn content is more preferably 0.80%, and yet more preferably 0.60%.

P: Up to 0.030%

Phosphorus (P) is an impurity. P decreases the SCC resistance of steel. In view of this, P content is preferably not higher than 0.030%. P content is more preferably not higher than 0.025%.

S: Up to 0.0020%

Sulfur (S) is an impurity. S decreases the hot workability of steel. In view of this, S content is preferably not higher than 0.0020%.

Cu: Below 0.50%

Copper (Cu) is an impurity. Cu content is preferably lower than 0.50%. Cu content is more preferably not higher than 0.10%, and yet more preferably not higher than 0.08%.

Cr: 11.50 to Below 14.00%

Chromium (Cr) improves the carbon dioxide corrosion resistance of steel. On the other hand, an excessively high Cr content decreases the toughness and hot workability of steel. In view of this, Cr content is preferably 11.50 to below 14.00%. A lower limit for Cr content is more preferably 12.00%, and yet more preferably 12.50%. An upper limit for Cr content is more preferably 13.50%, yet more preferably 13.20%, still more preferably 13.00%, and yet more preferably 12.80%.

Ni: Above 5.00% to 7.00%

Nickel (Ni) is an austenite-forming element, and is included to produce martensite in the microstructure of steel. Producing martensite in the microstructure provides levels of strength and toughness required from a steel pipe for pipelines. Further, in addition to its effect of producing martensite in the microstructure, Ni has the effect of increasing the toughness of steel. On the other hand, an excessively high Ni content increases retained austenite, which decreases the strength of steel. In view of this, Ni content is preferably above 5.00 to 7.00%. A lower limit for Ni content is preferably 5.50%, and more preferably 6.00%. An upper limit for Ni content is preferably 6.80%, and more preferably 6.60%.

Mo: Above 1.00 to 3.00%

Molybdenum (Mo) improves the sulfide stress-corrosion cracking resistance of steel. Further, Mo forms carbides during welding and prevents precipitation of Cr carbides, thus prevents decrease in SCC resistance at HAZs. On the other hand, an excessively high Mo content decreases the toughness of steel. In view of this, Mo content is preferably above 1.00 to 3.00%. A lower limit for Mo content is more preferably 1.50%, and yet more preferably 1.80%. An upper limit for Mo content is more preferably 2.80%, and yet more preferably 2.60%.

Ti: 0.02 to 0.50%

Titanium (Ti) forms carbides during welding and prevents precipitation of Cr carbides, and thus prevents decrease in SCC resistance at HAZs. On the other hand, an excessively high Ti content decreases the toughness of steel. In view of this, Ti content is preferably 0.02 to 0.50%. A lower limit for Ti content is more preferably 0.05%, and yet more preferably 0.10%. An upper limit for Ti content is more preferably 0.40%, and yet more preferably 0.30%.

Al: 0.001 to 0.100%

Aluminum (Al) deoxidizes steel. On the other hand, an excessively high Al content decreases the toughness of steel. In view of this, Al content is preferably 0.001 to 0.100%. A lower limit for Al content is more preferably 0.005%, and yet more preferably 0.010%. An upper limit for Al content is more preferably 0.080%, and yet more preferably 0.060%. Al content as used herein means the content of acid-soluble Al (so-called Sol. Al).

Ca: 0.0001 to 0.0040%

Calcium (Ca) improves the hot workability of steel. On the other hand, an excessively high Ca content decreases the toughness of steel. In view of this, Ca content is preferably 0.0001 to 0.0040%. A lower limit for Ca content is more preferably 0.0005%, and yet more preferably 0.0008%. An upper limit for Ca content is more preferably 0.0035%, and yet more preferably 0.0030%.

N: 0.0001 to Below 0.0200%

Nitrogen (N) forms nitrides and decreases the toughness of steel. On the other hand, excessively limiting N content leads to increased manufacturing costs. In view of this, N content is preferably 0.0001 to below 0.0200%. A lower limit for N content is more preferably 0.0010%, and yet more preferably 0.0020%. An upper limit for N content is more preferably 0.0100%.

The balance of the chemical composition of the hollow shell is Fe and impurities. Impurity as used herein means an element originating from ore or scrap used as raw material for steel or an element that has entered from the environment or the like during the manufacturing process.

In the chemical composition of the hollow shell, some Fe may be replaced by one or more elements selected from the group consisting of V, Nb and Co. Every one of V, Nb and Co is an optional element. That is, the chemical composition of the hollow shell may contain only one or more of V, Nb and Co, or contain none of them.

V: 0 to 0.500%

Vanadium (V) improves the strength of steel. This effect is produced if a small amount of V is contained. On the other hand, an excessively high V content decreases the toughness of steel. In view of this, V content is preferably 0 to 0.500%. A lower limit for V content is more preferably 0.001%, yet more preferably 0.005%, and still more preferably 0.010%. An upper limit for V content is more preferably 0.300%, and yet more preferably 0.200%.

Nb: 0 to 0.500%

Niobium (Nb) improves the strength of steel. This effect is produced if a small amount of Nb is contained. On the other hand, an excessively high Nb content decreases the toughness of steel. In view of this, Nb content is preferably 0 to 0.500%. A lower limit for Nb content is more preferably 0.001%, yet more preferably 0.005%, still more preferably 0.010%, and yet more preferably 0.020%. An upper limit for Nb content is more preferably 0.300%, and yet more preferably 0.200%.

Co: 0 to 0.500%

Cobalt (Co) is an austenite-forming element, and may be included to produce martensite in the microstructure of steel. This effect is produced if a small amount of Co is contained. On the other hand, an excessively high Co content decreases the strength of steel. In view of this, Co content is preferably 0 to 0.500%. A lower limit for Co content is preferably 0.001%, more preferably 0.005%, yet more preferably 0.010%, and still more preferably 0.020%. An upper limit for Co content is preferably 0.350%, more preferably 0.300%, and yet more preferably 0.280%.

The martensitic stainless steel pipe according to the present embodiment preferably has a microstructure with a volume fraction of martensite of 70% or larger. Martensite as used herein includes tempered martensite. The balance of the microstructure of the martensitic stainless steel pipe according to the present embodiment is mainly composed of retained austenite. The microstructure of the martensitic stainless steel pipe according to the present embodiment preferably has a volume fraction of ferrite no larger than 5%.

Although not limiting, the hollow shell may be manufactured in the following manner, for example.

A raw material having the same chemical composition as the hollow shell described above is prepared (step S1-1). For example, steel having the above-specified chemical composition is smelted and subjected to continuous casting or blooming to produce a billet. In addition to continuous casting or blooming, hot working, cold working and/or heat treatment, for example, may be performed.

The raw material is hot worked to produce a hollow shell (step S1-2). The hot working may be, for example, the Mannesmann or Ugine-Sejournet process.

The hollow shell that has been hot worked is quenched (step S1-3). The quenching may be any one of direct quenching, in-line quenching, and re-heat quenching. Direct quenching is a heat treatment in which a hollow shell at a high temperature directly after hot working is cooled from that state. In-line quenching is a heat treatment in which a hollow shell after hot working is soaked in a supplementary-heating furnace and then rapidly cooled. Re-heat quenching is a heat treatment in which a hollow shell after hot working is cooled to about room temperature before being re-heated to a temperature not lower than the $A_{c3}$ point and is then rapidly cooled.

The quenching temperature (i.e., temperature of the hollow shell directly before the rapid cooling) is preferably 850 to 1000° C. The cooling rate during rapid cooling is preferably not lower than 300° C./min.

The quenched hollow shell is tempered (step S1-4). Specifically, the hollow shell is held for a predetermined holding time at a retention temperature not higher than the $A_{c1}$ point, and is then cooled. The tempering is performed to eliminate distortion that has occurred during the quenching (step S1-3) and, in addition, adjust the mechanical properties of the steel pipe. Generally, the higher the retention temperature, or the longer the holding time, the lower the strength and the better the toughness of steel pipe. The retention temperature and holding time depend on the mechanical properties required.

The retention temperature for tempering is preferably 550 to 700° C. The holding time is preferably 10 to 180 minutes.

[Blasting Step]

Oxide scales that have been produced during the tempering are mechanically removed through blasting (step S2). The blasting step (step S2) is optional, and may be omitted. If the removal of oxide scales is performed, deterioration of acid solution used at the subsequent pickling step (step S3) can be prevented.

[Pickling Step]

In the implementation shown in FIG. 1, the pickling step (S3) includes pickling with sulfuric acid (S3-1) and pickling with nitrohydrofluoric acid (S3-2). The pickling with sulfuric acid is an optional step and may be omitted. The step of pickling with sulfuric acid may include, for example, the step of immersing the hollow shell in sulfuric acid solution and the step of water washing the hollow shell taken out of the sulfuric acid solution. Sulfuric acid may be replaced by another acid solution, such as hydrochloric acid.

Although not limiting, the sulfuric acid solution used may be an aqueous solution. Although not limiting, the concentration of the sulfuric acid may be, for example, 15 to 18 mass %. Although not limiting, the temperature of the sulfuric acid solution may be, for example, 25 to 80° C. A lower limit for the temperature is preferably 30° C., and more preferably 40° C. An upper limit for the temperature is preferably 70° C., and more preferably 65° C.

Although not limiting, the period of time for which the hollow shell is immersed in the sulfuric acid solution may be, for example, 10 to 90 minutes. A lower limit for this immersion time is preferably 15 minutes, and more preferably 20 minutes. An upper limit for the immersion time is preferably 60 minutes, more preferably 50 minutes, and yet more preferably 40 minutes.

The hollow shell taken out of the sulfuric acid solution is washed with water at room temperature (15 to 25° C.) for 1 to 5 minutes to remove the sulfuric acid solution adhering to the surface.

The immersion in sulfuric acid solution and the water washing may be repeated a plurality of times. If the immersion in sulfuric acid solution is repeated a plurality of times, the immersion time for sulfuric acid solution per round may be, for example, 10 to 90 minutes. A lower limit for the immersion time for sulfuric acid solution per round is preferably 15 minutes, and more preferably 20 minutes. An upper limit for the immersion time per round is preferably 60 minutes, more preferably 50 minutes, and yet more preferably 40 minutes.

In the pickling with nitrohydrofluoric acid (step S3-2), the hollow shell is immersed, for a predetermined period of time, in a nitrohydrofluoric acid solution of a predetermined concentration and at a predetermined temperature. This removes oxide scales on the surface of the hollow shell. The nitrohydrofluoric acid solution is a mixed solution of hydrofluoric acid and nitric acid. Although not limiting, the nitrohydrofluoric acid used may be an aqueous solution. Although not limiting, the concentration of hydrofluoric acid may be, for example, 3 to 10 mass %. Although not limiting, the concentration of nitric acid may be, for example, 5 to 20 mass %. As a result, although not limiting, the total concentration of nitrohydrofluoric acid may be, for example, 5 to 30 mass %.

Figure 2:
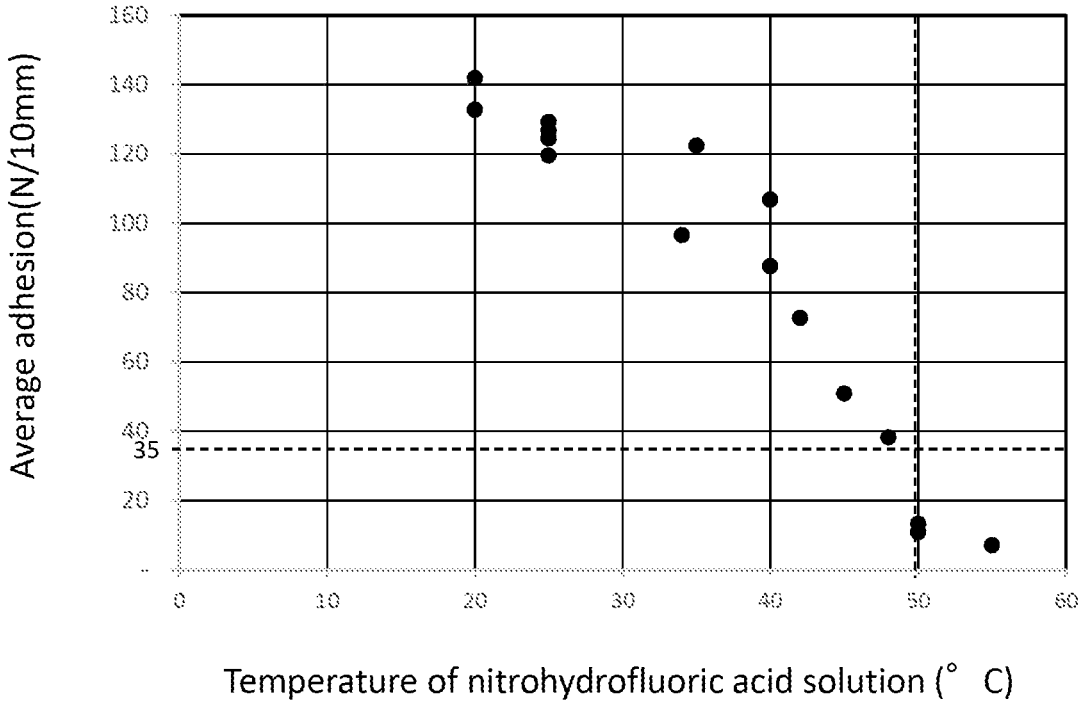
FIG. 2 shows the relationship between the average adhesion and the temperature of nitrohydrofluoric acid solution according to the embodiment of the present invention.

FIG. 2 shows the relationship between average adhesion for various test numbers of examples, discussed below, and the temperature of nitrohydrofluoric acid solution in the second pickling. The horizontal axis of the graph of FIG. 2 represents the temperature of the nitrohydrofluoric acid solution in the second pickling, while the vertical axis represents average adhesion. FIG. 2 was created by performing all of the steps of: a first pickling; water washing after the first pickling; a second pickling; water washing after the second pickling; high-pressure water washing;

hot-water immersion; and gas spraying from the examples discussed below, and then using the test results for which the time interval between the completion of hot-water immersion and the gas spraying is shorter than 15 minutes. FIG. 2 reveals that adhesion rapidly rises when the temperature of the nitrohydrofluoric acid solution becomes below 50° C.

Thus, the temperature of the nitrohydrofluoric acid solution in which the hollow shell is immersed is to be below 50° C. This prevents production of adhering substances on the surface of the hollow shell and thus prevents coloring in yellow. The temperature of the nitrohydrofluoric acid solution is preferably not higher than 40° C., more preferably not higher than 30° C., yet more preferably not higher than 25° C., and still more preferably lower than 25° C. A lower limit for the temperature of the nitrohydrofluoric acid solution is to be 5° C., preferably 10° C., and yet more preferably 15° C. Although not limiting, the mixture ratio between hydrofluoric acid and nitric acid may be, for example, 1:1 to 1:5.

Although not limiting, the immersion time for nitrohydrofluoric acid solution may be, for example, 1 to 10 minutes. A lower limit for the immersion time is preferably 2 minutes. On the other hand, an excessively long immersion time means lower manufacturing efficiency. To specify an upper limit, the immersion time may be, for example, not longer than 10 minutes; an upper limit is preferably 5 minutes, and more preferably 3 minutes. Further, during the pickling with nitrohydrofluoric acid, although not limiting, the ratio between the volume of pickling solution and the surface area of the material (i.e., specific amount of solution: volume of pickling solution/surface area of hollow shell) is preferably not lower than 10 ml/cm$^2$.

After step S3-2, the hollow shell is taken out of the nitrohydrofluoric acid solution and is washed, for 1 to 5 minutes, with water at room temperature (15 to 25° C.) to remove the nitrohydrofluoric acid solution adhering to the surface. This water washing step is optional, and may be omitted.

[High-Pressure Water Washing Step]

At step S4 of FIG. 1, water at room temperature under high pressure is injected onto the entire outer surface of the hollow shell to remove the adhering substances remaining on the surface. A high-pressure water washer is used to inject high-pressure water onto the hollow shell. Further, high-pressure water washing prevents production of adhering substances on the surface of the hollow shell.

At the high-pressure water washing step, a person may hold the injection nozzles of the high-pressure water washer to inject high-pressure water onto the entire outer surface of the hollow shell. Alternatively, a device capable of supporting the injection nozzles and changing their positions relative to the hollow shell may be used to inject high-pressure water onto the entire outer surface of the hollow shell. At the high-pressure water washing step, high-pressure water is injected onto the entire outer surface of the hollow shell.

Although not limiting, the discharge pressure of the injection nozzles of the high-pressure water washer is preferably not lower than 0.98 MPa (not lower than 10 kgf/cm$^2$), and more preferably not lower than 1.47 MPa (not lower than 15 kgf/cm$^2$). A lower limit for the discharge pressure of the injection nozzles is more preferably 1.96 MPa (20 kgf/cm$^2$). Although not limiting, an upper limit for the discharge pressure of the injection nozzles is preferably 8.83 MPa (90 kgf/cm$^2$), and more preferably 3.92 MPa (40 kgf/cm$^2$).

Although not limiting, the diameter of the injection tips of the injection nozzles is preferably 0.8 to 3.0 mm. A lower limit for the diameter of the injection tips of the injection nozzles is preferably 1.0 mm, and more preferably 1.3 mm. An upper limit for the diameter of the injection tips of the injection nozzles is preferably 2.5 mm, and more preferably 2.0 mm.

Although not limiting, the distance between the injection tips of the injection nozzles, on one hand, and the hollow shell, on the other, is preferably not larger than 2.7 m. An upper limit for the distance between the injection tips of the injection nozzles and the hollow shell is preferably 1.8 m. Although not limiting, a lower limit for the distance between the injection tips of the injection nozzles and the hollow shell is preferably 0.5 m, and more preferably 1.0 m.

Although not limiting, the amount of high-pressure water being injected per unite area of the outer surface of the hollow shell is preferably not smaller than 144 L/m$^2$. A lower limit for the amount of water being injected is preferably 200 L/m$^2$, and more preferably 312 L/m$^2$. An upper limit for the amount of high-pressure water being injected per unite area of the outer surface of the hollow shell is, for example, preferably 1440 L/m$^2$, more preferably 1200 L/m$^2$, and yet more preferably 1000 L/m$^2$.

Further, at the high-pressure water washing step, although not necessary, high-pressure water may be injected onto the inner surface of the hollow shell to perform high-pressure water washing on the inner surface. For example, the injection nozzles may be inserted into the hollow shell to perform high-pressure water washing on the inner surface of the hollow shell.

[Hot-Water Immersion Step]

After the high-pressure water washing, the hollow shell may immersed in hot water (S5). The hot-water immersion step raises the temperature of the hollow shell to promote the drying of the outer surface at the subsequent step. In this case, it is preferable that, immediately after the high-pressure water washing, the hollow shell is immersed in hot water. For example, the time interval between the completion of high-pressure water injection onto the hollow shell and the initiation of the immersion of the hollow shell in hot water is to be shorter than 15 minutes, preferably shorter than 13 minutes, more preferably shorter than 10 minutes, and yet more preferably shorter than 6 minutes. The hot-water immersion step is not essential, and may be omitted.

Although not limiting, the temperature of hot water in which the hollow shell is immersed at the hot-water immersion step is preferably not lower than 60° C. A lower limit for the temperature of hot water in which the hollow shell is immersed (i.e., hot-water temperature) is preferably 70° C., and more preferably 80° C. An upper limit for the temperature of hot water in which the hollow shell is immersed (i.e., hot-water temperature) is, for example, preferably 90° C., which is lower than the boiling point of water.

Although not limiting, the period of time for which the hollow shell is immersed in hot water at the hot-water immersion step is preferably not shorter than 1 minute. A lower limit for the period of time for which the hollow shell is immersed in hot water is more preferably 1 minute 30 seconds, and yet more preferably 2 minutes. Although not limiting, an upper limit for the period of time for which the hollow shell is immersed in hot water is preferably 15 minutes, more preferably 10 minutes, and yet more preferably 5 minutes.

[Gas Spraying Step]

At step S6, i.e., the gas spraying step, gas is injected onto the outer surface of the steel pipe that has undergone hot-water immersion or high-pressure water washing. This blows off the water adhering to the outer surface of the steel pipe. Further, this promotes the drying of the outer surface of the steel pipe. Although not limiting, the gas being injected may be air. Other than air, the gas being injected may be nitrogen or argon, for example. Although not limiting, the injection pressure may be 0.2 to 0.5 MPa.

The time interval between the completion of the step immediately before the gas spraying step (in the present implementation, completion of immersion in hot water) and the initiation of gas spraying is to be shorter than 15 minutes, preferably shorter than 13 minutes, more preferably shorter than 10 minutes, and yet more preferably shorter than 6 minutes. By thus spraying the hollow shell with gas immediately after the completion of its immersion in the liquid at the previous step, production of adhering substances on the surface of the hollow shell can be prevented, thereby preventing coloring of the surface of the hollow shell in yellow.

Further, at the gas spraying step, although not necessary, the inner surface of the steel pipe may be sprayed with gas. This will blow off the liquid adhering to the inner surface of the steel pipe. This will promote the drying of the inner surface of the steel pipe. For example, the injection nozzles may be inserted into the steel pipe to spray gas onto the inner surface of the steel pipe.

As shown in FIG. 1, after the pickling with nitrohydrofluoric acid solution at a temperature below 50° C., the outer surface of the hollow shell is washed with high-pressure water and, immediately thereafter, gas is sprayed to prevent production of adhering substances on the surface of the hollow shell, thus preventing coloring of the surface of the hollow shell in yellow.

After carefully observing the outer surface of a hollow shell that exhibited a decrease in the pipe's adhesion to its coating resin, the inventors found coloring of the surface in yellow. They estimated that the coloring was caused by substances that adhered to the surface of the steel pipe after pickling. Further, they found that the presence/absence depends on the pickling conditions. In view of this, they attempted to find conditions for pickling and the subsequent treatment that would prevent coloring in yellow, and found that the surface of martensitic stainless steel pipe experiences coloring in yellow if the temperature of nitrohydrofluoric acid solution used for the pickling is not lower than 50° C. This is thought to be caused by the adhesion of by-products due to excessive pickling. They further found that, if high-pressure water washing is not performed, corrosive products still adhere to the surface of the steel pipe, causing coloring in black. Furthermore, they found that the surface of martensitic stainless steel pipe exhibits coloring in yellow if the surface of the steel pipe after the pickling with nitrohydrofluoric acid solution remains wet and exposed to air for 15 minutes or longer. This is thought to be caused by adhering substances such as corrosive products or impurities produced by concentrated pickling solution or remaining liquid from the hot-water immersion.

According to these findings, setting the conditions for nitrohydrofluoric acid solution, high-pressure water washing and gas spraying as in the above embodiments will prevent coloring of martensitic stainless steel pipe after the pickling in yellow. This will prevent a decrease in the adhesion of the surface of the steel pipe to its coating resin. Further, deterioration of the surface appearance of the steel pipe can be prevented.

By virtue of the conditions for nitrohydrofluoric acid solution, high-pressure water washing and gas spraying in the above embodiments, the color of the outer surface of martensitic stainless steel pipe having the above-specified chemical composition will be close to silver. That is, the RGB value obtained by colorimetry on the outer surface of martensitic stainless steel pipe will satisfy Conditions 1 to 4, discussed below. This will provide good adhesion of the surface of the steel pipe and good surface appearance. The RGB value is represented by values for R, G and B expressing the red, green and blue components, respectively, on a 256-level gray scale from 0 to 255. The value for R, the value for G and the value for B of the RGB value obtained by colorimetry on the outer surface of martensitic stainless steel are substituted for R, G and B, respectively, in the expressions for Conditions 1 to 4, provided below.

Condition 1: $154 \leq B \leq 255$;

Condition 2: Condition 1 being satisfied, $146 \leq R \leq 255$ and $142 \leq G \leq 255$ being satisfied, where a case with $R=G=B=255$ is excluded;

Condition 3: Condition 2 being satisfied, where a case with $504 \leq (R-G) \times (R-B) \leq 1960$ is excluded; and Condition 4: Condition 2 being satisfied and $-48 \leq (R-G) \times (R-B) \leq 396$ being satisfied, where a case with $(R-G) \times (R-B)=220$ and a case with $(R-G) \times (R-B)=272$ are excluded.

If the RGB value of the color of the outer surface of a martensitic stainless steel pipe having the above-specified chemical composition satisfies Condition 1 above, the outer surface's adhesion to its coating resin will be ensured. If the color of a martensitic stainless steel pipe satisfies Condition 2 above, the color of the surface of the steel pipe will be close to silver, providing good adhesion and good surface appearance. If the color of a martensitic stainless steel pipe satisfies Condition 3 above, even better adhesion and surface appearance will be obtained. If the color of a martensitic stainless steel pipe satisfies Condition 4 above, yet better adhesion and surface appearance will be obtained.

The RGB value of the outer surface of martensitic stainless steel pipe can be obtained by colorimetry using a digital microscope (VHX-6000 from Keyence Corporation). The measurement conditions may be as follows: the light source uses high-brightness LEDs (color temperature: 5700 K), and the illuminance is 1000 lux or higher. A portion of the outer surface of the steel pipe located at a measurement position is captured by the digital microscope for colorimetry to provide an RGB value. Specifically, a visual inspection determines in advance that the color of the entire outer surface of a steel pipe is generally uniform; one position in a middle portion of the steel pipe as determined along its longitudinal direction is selected; 5 fields of view are observed by colorimetry, each field having an area of 1 mm×1 mm; then, the average value is treated as the RGB value of this particular steel pipe.

To determine whether a martensitic stainless steel pipe satisfies each of Conditions 1 to 4 above, the measurement of an RGB value is performed on a total of 12 locations, that is, 4 locations along the circumference (with a 90° distance) of the martensitic stainless steel pipe for each of 3 positions along its longitudinal direction (i.e., longitudinal middle and positions 1 m away from both ends). The determination is made based on whether the RGB values for 9 or more of those 12 positions satisfy each of the conditions. That is, one given martensitic stainless steel pipe is determined to satisfy Conditions 1 to 4 if the RGB values for 9 or more of the above 12 positions satisfy Conditions 1 to 4. This criterion is based on the fact that, if the color of the outer surface of a martensitic stainless steel pipe as a whole satisfies Conditions 1 to 4, the effects of these conditions are produced even if there are some portions of the outer surface that have different colors but are small enough in area to be ignored. Theoretically, for the purpose of determination based on Conditions 1 to 4, it suffices if a visual inspection determines in advance that the entire outer surface of the steel pipe has a generally uniform color and a determination is made as to whether the RGB value obtained by colorimetry on an area at one position of the outer surface in the longitudinal middle of the steel pipe satisfies Conditions 1 to 4. To ensure the objectivity of a determination, the determination method employed involves determining whether the RGB values for 9 or more of the above 12 positions satisfy Conditions 1 to 4.

Good adhesion and surface appearance can be obtained if the color of the outer surface of a martensitic stainless steel pipe having the above-specified chemical composition is one of the colors shown in Table 1 below. The color names shown in Table 1 are mainly based on the 269 common colors (JIS Z 8102:2001). The color names in Table 1 are provided to facilitate intuitive understanding of the color of an RGB value.

[Table 1]

TABLE 1

| Color code | Color components (red, green and blue) R | G | B | (R-G)/(RB) | Color name |
|---|---|---|---|---|---|
| #CCCF9A | 204 | 207 | 154 | −150 | rikyu-shirahca (lightly grayish, yellowish brown) |
| #928E9E | 146 | 142 | 158 | −48 | uzunezu/usunezumi (light gray) |
| #EDF0E0 | 237 | 240 | 224 | −39 | oyster white, kaki-iro/namagaki-iro (oyster white) |
| #E2E3CB | 226 | 227 | 203 | −23 | parchment) |
| #FFFFFB | 255 | 255 | 251 | 0 | white |
| #FJFJFJ | 241 | 241 | 241 | 0 | shiro (white) |
| #BABAC6 | 186 | 186 | 198 | 0 | sky gray |
| #C0C0C0 | 192 | 192 | 192 | 0 | silver, shirokaue-iro (silver) |
| #BDBDB7 | 189 | 189 | 183 | 0 | pearl gray |
| #E6E7E8 | 230 | 231 | 232 | 2 | kaihakushoku (ash color) |
| #FFFEF9 | 255 | 254 | 249 | 6 | gofun-iro (whitewash) |
| #FFFEF6 | 255 | 254 | 246 | 9 | miruku-iro (mikly), milky white, nyuhakushoku (opal) |
| #B1B3B6 | 177 | 179 | 182 | 10 | usunibi-iro/usunibu-iro (ligh-bluish gray) |
| #A1A3A6 | 161 | 163 | 166 | 10 | ginkaishoku (silver gray) |
| #E6E5EA | 246 | 245 | 234 | 12 | kinari-iro (ecru) |
| #EFFEF2 | 255 | 254 | 242 | 13 | pearl white, shinju-iro (pear gray) |
| #F7FCFE | 247 | 252 | 254 | 35 | unohana-iro (deutzra-like, slightly yellowish white) |
| #F2E8EC | 242 | 232 | 236 | 60 | gofun-iro (whitewash) |
| #F4FBFE | 244 | 251 | 254 | 70 | snow white |
| #CADBCF | 202 | 219 | 207 | 85 | byakuryoku (whitish pale green) |
| #F0F8FF | 240 | 248 | 255 | 120 | Alice blue |
| #CCE7D3 | 204 | 231 | 211 | 189 | ice green |
| #E3ECD8 | 243 | 236 | 216 | 189 | ivory/ivory white, zoge-iro (ivory-white) |
| #F0E2E0 | 240 | 226 | 224 | 224 | kinari-iro (ecru) |
| #FFF6DC | 255 | 246 | 220 | 315 | torinoko-iro (eggshell) |
| #C0CDDC | 192 | 205 | 220 | 364 | fountain blue |
| #E3D4CA | 227 | 212 | 202 | 375 | ivory |
| #FFF4DB | 255 | 244 | 219 | 396 | neri-iro (yam-like, slightly yellowish white) |
| #C9B9A8 | 201 | 185 | 168 | 528 | sunairo (sand color) |
| #E8DABE | 232 | 218 | 190 | 588 | ama-iro (flax color) |

EXAMPLES

The present invention will now be described more specifically by means of examples. The present invention is not limited to these examples.

A hollow shell was pickled with a sulfuric acid solution and a nitrohydrofluoric acid solution and then washed with water, followed by high-pressure water washing, hot-water immersion and gas spraying in this order. The gas spraying was followed by colorimetry for the RGB value of the outer surface of the steel pipe and measurement of the average adhesion (i.e., peel strength).

The chemical composition and size of each of the hollow shells used in the tests, as well as the conditions for pickling, high-pressure water washing, hot-water immersion and gas spraying will be specified below.

[Steel Pipe]

The chemical compositions of the hollow shells (generally shared by the fabricated steel pipes) are shown in Table 2. In Table 2, the unit is mass %, and the balance is Fe and impurities. The size of each hollow shell is represented by a diameter of 317.9 mm, a wall thickness of 12.9 mm and a length of 12 m.

[Table 2]

TABLE 2

| Steel character | Chemical composition (in mass %, balance Fe and impurities) C | Si | Mn | P | S | Cu | Cr | Ni | Mo | Ti | Al | Ca | N | V | Nb | Co |
|---|---|---|---|---|---|---|---|---|---|---|---|---|---|---|---|---|
| A | 0.009 | 0.25 | 0.35 | 0.015 | 0.0006 | 0.05 | 11.98 | 6.39 | 2.41 | 0.10 | 0.038 | 0.0016 | 0.0070 | 0.050 | 0.001 | 0.240 |
| B | 0.010 | 0.25 | 0.34 | 0.015 | 0.0006 | 0.05 | 12.00 | 6.38 | 2.40 | 0.10 | 0.038 | 0.0015 | 0.0073 | 0.050 | 0.001 | 0.240 |
| C | 0.009 | 0.24 | 0.41 | 0.017 | 0.0005 | 0.18 | 12.05 | 5.52 | 1.99 | 0.10 | 0.032 | 0.0028 | 0.0003 | 0.060 | 0.003 | — |
| D | 0.007 | 0.25 | 0.40 | 0.015 | 0.0007 | 0.19 | 11.96 | 5.47 | 1.94 | 0.10 | 0.033 | 0.0033 | 0.0004 | 0.060 | — | 0.160 |
| E | 0.009 | 0.24 | 0.41 | 0.017 | 0.0005 | 0.18 | 12.03 | 5.53 | 1.99 | 0.10 | 0.033 | 0.0024 | 0.0004 | — | 0.002 | 0.160 |
| F | 0.009 | 0.24 | 0.41 | 0.017 | 0.0005 | 0.18 | 12.04 | 5.51 | 1.98 | 0.10 | 0.032 | 0.0020 | 0.0004 | — | — | — |
| G | 0.009 | 0.25 | 0.35 | 0.016 | 0.0005 | 0.05 | 12.09 | 6.49 | 2.53 | 0.10 | 0.036 | 0.0017 | 0.0024 | — | 0.001 | — |
| H | 0.008 | 0.24 | 0.37 | 0.014 | 0.0005 | 0.04 | 12.04 | 6.57 | 2.52 | 0.10 | 0.034 | 0.0022 | 0.0043 | — | — | 0.230 |
| I | 0.021 | 0.25 | 0.33 | 0.015 | 0.0006 | 0.05 | 12.78 | 6.02 | 1.92 | 0.10 | 0.037 | 0.0027 | 0.0010 | — | — | — |
| J | 0.015 | 0.24 | 0.41 | 0.015 | 0.0005 | 0.04 | 12.61 | 6.33 | 1.44 | 0.10 | 0.032 | 0.0018 | 0.0048 | — | — | — |
| K | 0.026 | 0.24 | 0.35 | 0.017 | 0.0007 | 0.05 | 13.47 | 6.42 | 2.51 | 0.10 | 0.036 | 0.0016 | 0.0022 | — | — | — |

[Pickling]

[First pickling] Sulfuric acid solution; concentration: 18 mass %

[Water washing after first pickling] Temperature: 25° C. (room temperature); time: 2 min

[Second pickling] nitrohydrofluoric acid solution; concentration: 15 mass % (hydrofluoric acid in 5 mass %+nitric acid in 10 mass %)

[Water washing after second pickling] temperature: 25° C. (room temperature); time: 2 min or no washing

[High-Pressure Water Washing]

Discharge pressure of injection nozzles: 0.98 MPa (10 kgf/cm$^2$);

Diameter of injection tips of injection nozzles: 1.3 mm

Distance between injection tips of injection nozzles and surface of steel pipe: 2.7 m Amount of high-pressure water injected per unite area of outer surface of hollow shell: 144 L/m$^2$ (injected for 7.2 minutes along entire length around 360 degrees in circumference); and Amount of water injected per unit time by high-pressure water washer: 240 L/min.

[Hot-Water Immersion]

Temperature of hot water: 80° C.; and

Time for which steel pipe is immersed in hot water: 2 min, or no immersion at all.

[Gas Spraying]

Type of gas: air; and

Injection pressure: 0.3 MPa (3 kgf/cm$^2$).

The amount of high-pressure water being injected per unit area, "144 L/m$^2$", is a value calculated from measurements involving a process in which high-pressure water was injected, for 2.4 minutes, onto an area of one-third of the outer circumference of a steel pipe along the entire length of the pipe, where this process was performed three times while the steel pipe was being rotated by 120 degrees in each interval, i.e., performed from three directions. That is, this value "144 L/m$^2$" is a value calculated from measurements where high-pressure water was injected to one-third of the outer surface of the steel pipe for 2.4 minutes. The area equivalent to ⅓ of the outer surface of the steel pipe was 3.99 mm$^2$, and the injection time per unite area, 1 m$^2$, was 2.4 min/3.99 mm$^2$=0.602 min/m$^2$. The amount of water injected per 1 m$^2$ was 0.602 min/m$^2$×240 L/min=144 L/m$^2$.

[Measurement of RGB Value]

A digital microscope (VHX-6000 from Keyence Corporation) was used to perform colorimetry on the outer surface of steel pipe.

Light source: High-brightness LEDs (color temperature: 5700 K);

Illuminance: 1000 lux or higher; and

Evaluation method: A visual inspection determined in advance that the color of the entire outer surface of a steel pipe was generally uniform; one position in a longitudinal middle of the steel pipe was selected; 5 fields of view were observed by colorimetry, each field having an area of 1 mm×1 mm; then, the average value was treated as the RGB value of the steel pipe.

[Measurement of Adhesion (Peel Strength)]

Coating application method: PE 1H of JIS G3477-2:2018;

Coating resin: Polyethylene meeting requirements of JIS G 3477-2:2018, Annex A;

Adhesive: Modified polyethylene containing modified maleic acid meeting requirements of JIS G 3477-2:2018, Annex B; and Evaluation method: Peel-strength testing method in accordance with JIS G 3477-2:2018, Annex E.

A test specimen was taken from a middle portion of a resin-coated steel pipe as determined along its pipe-axis direction, the specimen having a length of 200 mm, a width of 80 mm and the entire wall thickness. Three pairs of cuts were made, each cut extending parallel to the pipe axis to reach the steel pipe itself and having a width of 10 mm and a length of 200 mm. The testing temperature was 250° C. The average of the obtained peel strengths of the three pairs was treated as the average adhesion. An example with an average adhesion of 35.0 N/10 mm or higher was determined to provide good adhesion.

Table 3 below shows the various conditions for the tests as well as the measurement results.

[Table 3]

TABLE 3

| | | 1st pickling | | | | 2nd pickling | | | |
|---|---|---|---|---|---|---|---|---|---|
| Test No. | Steel character | Temp. (° C.) | Concent. (mass %) | Time (min) | Water washing (min) | Temp. (° C.) | Concent. (mass %) | Time (min) | Water washing (min) |
| 1 | A | 60 | 18 | 40 | 2 | 25 | 5 + 10 | 2 | 2 |
| 2 | A | 60 | 18 | 40 | 2 | 25 | 5 + 10 | 2 | no |
| 3 | A | 60 | 18 | 40 | 2 | 25 | 5 + 10 | 2 | 2 |
| 4 | B | 60 | 18 | 40 | 2 | 25 | 5 + 10 | 2 | 2 |
| 5 | C | 60 | 18 | 40 | 2 | 20 | 5 + 10 | 4 | 2 |
| 6 | D | 60 | 18 | 40 | 2 | 20 | 5 + 10 | 4 | 2 |
| 7 | F | 60 | 18 | 40 | 2 | 35 | 5 + 10 | 2 | 2 |
| 8 | F | 50 | 18 | 60 | 2 | 40 | 5 + 10 | 2 | 2 |
| 9 | G | 50 | 18 | 50 | 2 | 34 | 5 + 10 | 2 | 2 |
| 10 | H | 60 | 18 | 40 | 2 | 40 | 5 + 10 | 2 | 2 |
| 11 | A | 50 | 18 | 60 | 2 | 50 | 5 + 10 | 2 | 2 |
| 12 | A | 50 | 18 | 60 | 2 | 55 | 5 + 10 | 2 | 2 |
| 13 | B | 60 | 18 | 40 | 2 | 25 | 5 + 10 | 2 | 2 |
| 14 | B | 60 | 18 | 40 | 2 | 25 | 5 + 10 | 2 | 2 |
| 15 | C | 60 | 18 | 40 | 2 | 25 | 5 + 10 | 2 | 2 |
| 16 | D | 60 | 18 | 50 | 2 | 48 | 5 + 10 | 5 | 2 |
| 17 | D | 50 | 18 | 60 | 2 | 45 | 5 + 10 | 2 | 2 |

TABLE 3-continued

| | | | | | | | | | |
|---|---|---|---|---|---|---|---|---|---|
| 18 | C | 50 | 18 | 60 | 2 | 42 | 5 + 10 | 2 | 2 |
| 19 | D | 60 | 18 | 40 | 2 | 50 | 5 + 10 | 2 | 2 |
| 20 | I | 60 | 18 | 40 | 2 | 25 | 5 + 10 | 2 | 2 |
| 21 | J | 60 | 18 | 40 | 2 | 25 | 5 + 10 | 2 | 2 |
| 22 | K | 60 | 18 | 40 | 2 | 25 | 5 + 10 | 2 | 2 |

| Test No. | High-pressure water washing | Hot-water immersion (min) | Time interval between completion of previous stop and initiation of gas spraying (min) | Surface color of steel pipe R (red) | G (green) | B (blue) | (R G)/(R-B) | Average adhesion (N/10 mm) |
|---|---|---|---|---|---|---|---|---|
| 1 | yes | 2 | 5 | 230 | 231 | 232 | 2 | 124.6 |
| 2 | yes | 2 | 5 | 226 | 227 | 203 | −23 | 111.3 |
| 3 | yes | no | 5 | 192 | 192 | 192 | 0 | 107.8 |
| 4 | yes | 2 | 3 | 237 | 240 | 224 | −39 | 129.3 |
| 5 | yes | 2 | 3 | 247 | 252 | 254 | 35 | 142.0 |
| 6 | yes | 2 | 5 | 235 | 239 | 241 | 24 | 132.8 |
| 7 | yes | 2 | 3 | 236 | 239 | 220 | −48 | 122.5 |
| 8 | yes | 2 | 8 | 189 | 189 | 182 | 0 | 106.9 |
| 9 | yes | 2 | 10 | 186 | 186 | 198 | 0 | 96.6 |
| 10 | yes | 2 | 13 | 177 | 179 | 182 | 10 | 87.7 |
| 11 | yes | 2 | 3 | 201 | 171 | 83 | 3540 | 11.0 |
| 12 | yes | 2 | 3 | 203 | 197 | 71 | 792 | 7.2 |
| 13 | no | 2 | 3 | 45 | 25 | 20 | 500 | — |
| 14 | yes | 2 | 15 | 250 | 198 | 30 | 11440 | 5.6 |
| 15 | yes | 2 | 20 | 145 | 141 | 64 | 324 | — |
| 16 | yes | 2 | 13 | 108 | 141 | 155 | 1551 | 38.3 |
| 17 | yes | 2 | 13 | 201 | 185 | 168 | 528 | 50.9 |
| 18 | yes | 2 | 13 | 180 | 221 | 192 | 492 | 72.7 |
| 19 | yes | 2 | 5 | 159 | 145 | 144 | 210 | 13.4 |
| 20 | yes | 2 | 5 | 230 | 233 | 235 | 15 | 119.6 |
| 21 | yes | 2 | 5 | 226 | 228 | 232 | 12 | 124.5 |
| 22 | yes | 2 | 5 | 234 | 229 | 220 | 70 | 126.8 |

Referring to Table 3, for each of Test Nos. 1, 2, 4 to 10 and 16 to 18, the temperature of nitrohydrofluoric acid solution was lower than 50° C., high-pressure water washing and hot-water immersion were performed, and gas spraying was initiated before a lapse of 15 minutes from completion of the hot-water immersion. As a result, the average adhesion was not lower than 35.0 N/10 mm, exhibiting good adhesion.

For Test No. 3, the temperature of nitrohydrofluoric acid solution was lower than 50° C., high-pressure water washing was performed, and gas spraying was initiated before a lapse of 15 minutes from completion of the previous step, i.e., high-pressure water washing. As a result, the average adhesion was not lower than 35.0 N/10 mm, exhibiting good adhesion.

On the other hand, for each of Test Nos. 11, 12 and 19, the temperature of nitrohydrofluoric acid solution was not lower than 50° C. As a result, the average adhesion was lower than 35.0 N/10 mm, failing to exhibit good adhesion.

For Test No. 13, high-pressure water washing was not performed. As a result, the adhesion was extremely low, making evaluation impossible (indicated by "–" in Table 3).

For Test Nos. 14 and 15, gas spraying was initiated after a lapse of 15 minutes or longer from completion of the previous step, i.e., water immersion. As a result, for Test No. 14, the average adhesion was lower than 35.0 N/10 mm, failing to exhibit good adhesion. For Test No. 15, the adhesion was extremely low, making evaluation impossible (indicated by "–" in Table 3).

Referring to Table 3, for Test Nos. 1 to 10 and 20 to 22, the RGB values satisfied all of Conditions 1 to 4 specified above. That is, the steel pipes labeled Test Nos. 1 to 10 and 20 to 22 had no coloring in yellow. As a result, the average adhesion was not lower than 35.0 N/10 mm, exhibiting good adhesion.

On the other hand, the RGB values for Test Nos. 11 to 15 and 19 failed to satisfy Condition 1. As a result, the average adhesion was lower than 35.0 N/10 mm, failing to exhibit good adhesion.

For Test No. 16, the RGB value satisfied Condition 1, but failed to satisfy Condition 2. As a result, the average adhesion was not lower than 35.0 N/10 mm, exhibiting good adhesion. However, the average adhesion was lower than 50.0 N/10 mm, lower than those for the examples that satisfied Conditions 1 and 2.

For Test No. 17, the RGB value satisfied Conditions 1 and 2, but failed to satisfy Condition 3. As a result, the average adhesion was not lower than 35.0 N/10 mm, exhibiting good adhesion. However, the average adhesion was lower than 70.0 N/10 mm, lower than those for examples that satisfied Conditions 1 to 3.

For Test No. 18, the RGB value satisfied Conditions 1 to 3, but failed to satisfy Condition 4. As a result, the average adhesion was not lower than 35.0 N/10 mm, exhibiting good adhesion. However, the average adhesion was lower than 85.0 N/10 mm, lower than those for examples that satisfied all of Conditions 1 to 4.

Embodiments of the present invention have been described. The above-described embodiments are exemplary only, intended to allow the present invention to be carried out. Accordingly, the present invention is not limited to the above-described embodiments, and the above-described embodiments, when carried out, may be modified as appropriate without departing from the spirit of the invention.

The present invention is applicable to a martensitic stainless steel pipe, and preferably applicable to a martensitic stainless seamless steel pipe.

The invention claimed is:

1. A method of manufacturing a martensitic stainless steel pipe, comprising:

preparing a hollow shell having a chemical composition of, in mass %:

0.001 to 0.050% C;
0.05 to 1.00% Si;
0.05 to 1.00% Mn;
up to 0.030% P;
up to 0.0020% S;
below 0.50% Cu;
11.50 to below 14.00% Cr;
above 5.00 to 7.00% Ni;
above 1.00 to 3.00% Mo;
0.02 to 0.50% Ti;
0.001 to 0.100% Al;
0.0001 to 0.0040% Ca;
0.0001 to below 0.0200% N;
0 to 0.500% V;
0 to 0.500% Nb;
0 to 0.500% Co; and
balance Fe and impurities;

a pickling step in which the hollow shell is immersed in nitrohydrofluoric acid solution at a temperature below 50° C.;

after the pickling step, a high-pressure water washing step in which high-pressure water is injected onto an outer surface of the hollow shell to clean the outer surface of the hollow shell and a discharge pressure of an injection nozzle of a high-pressure water washer is not lower than 0.98 MPa; and a gas spraying step in which the outer surface of the hollow shell is sprayed with gas before a lapse of 15 minutes from completion of the high-pressure water washing step.

2. A method of manufacturing a martensitic stainless steel pipe comprising:

preparing a hollow shell having a chemical composition of, in mass %:

0.001 to 0.050% C;
0.05 to 1.00% Si;
0.05 to 1.00% Mn;
up to 0.030% P;
up to 0.0020% S;
below 0.50% Cu;
11.50 to below 14.00% Cr;
above 5.00 to 7.00% Ni;
above 1.00 to 3.00% Mo;
0.02 to 0.50% Ti;
0.001 to 0.100% Al;
0.0001 to 0.0040% Ca;
0.0001 to below 0.0200% N;
0 to 0.500% V;
0 to 0.500% Nb;
0 to 0.500% Co; and
balance Fe and impurities;

a pickling step in which the hollow shell is immersed in nitrohydrofluoric acid solution at a temperature below 50° C.;

after the pickling step, a high-pressure water washing step in which high-pressure water is injected onto an outer surface of the hollow shell to clean the outer surface of the hollow shell and a discharge pressure of an injection nozzle of a high-pressure water washer is not lower than 0.98 MPa;

after the high-pressure water washing step, a hot-water immersion step in which the hollow shell is immersed in hot water; and a gas spraying step in which the outer surface of the hollow shell is sprayed with gas before a lapse of 15 minutes from completion of the hot-water immersion step.

3. The method of manufacturing a martensitic stainless steel pipe according to claim 1, wherein, at the pickling step, the hollow shell is immersed in nitrohydrofluoric acid solution at a temperature below 30° C.

4. The method of manufacturing a martensitic stainless steel pipe according to claim 2, wherein, at the pickling step, the hollow shell is immersed in nitrohydrofluoric acid solution at a temperature below 30° C.

* * * * *